US010034080B2

(12) United States Patent
Qin

(10) Patent No.: US 10,034,080 B2
(45) Date of Patent: Jul. 24, 2018

(54) SPEAKER

(71) Applicant: Peng Qin, Shenzhen (CN)

(72) Inventor: Peng Qin, Shenzhen (CN)

(73) Assignee: AAC TECHNOLOGIES PTE. LTD., Singapore (SG)

( * ) Notice: Subject to any disclaimer, the term of this patent is extended or adjusted under 35 U.S.C. 154(b) by 0 days.

(21) Appl. No.: 15/417,053

(22) Filed: Jan. 26, 2017

(65) Prior Publication Data

US 2018/0124505 A1 May 3, 2018

(30) Foreign Application Priority Data

Oct. 27, 2016 (CN) ..... 2016 2 1181012 U
Oct. 27, 2016 (CN) ..... 2016 2 1181134 U
Oct. 27, 2016 (CN) ..... 2016 2 1181508 U

(51) Int. Cl.
*H04R 1/02* (2006.01)
*H04R 1/28* (2006.01)

(52) U.S. Cl.
CPC ..... *H04R 1/2857* (2013.01); *H04R 1/2849* (2013.01)

(58) Field of Classification Search
CPC . H04R 1/2857; H04R 1/2849; H04R 2499/11
USPC ..... 381/347, 345
See application file for complete search history.

(56) References Cited

U.S. PATENT DOCUMENTS 4,889,208 A * 12/1989 Sugihara ..... H04R 1/288 181/141
9,288,561 B1 * 3/2016 Chu ..... H04R 1/2834

* cited by examiner

*Primary Examiner* — Sunita Joshi
(74) *Attorney, Agent, or Firm* — Na Xu; IPro, PLLC

(57) ABSTRACT

A speaker is provided in the present disclosure. The speaker includes a box body with a receiving space and a sound production unit received in the receiving space, the sound production unit comprises a diaphragm for vibrating to produce sound, the diaphragm is spaced from the box body to form a front sound cavity, and the box body comprises a sound outlet channel communicating the front sound cavity with the outside and a plurality of baffles disposed in the sound outlet channel and staggered at intervals.

17 Claims, 8 Drawing Sheets

SPEAKER

FIELD OF THE DISCLOSURE

The present disclosure generally relates to sound production device, and more particularly, to a sound production device using in the electronic production.

BACKGROUND

As electronic consumer products are increasingly thin, sound cavity structures of loudspeaker boxes of portable electronic equipment such as mobile phones, tablet computers and the like have been gradually changed from a front sound outlet mode to a side sound outlet mode.

The speaker in relevant technologies includes a box body with a receiving space and a sound production unit received in the receiving space, the sound production unit includes a diaphragm for vibrating to produce sound, the box body and the diaphragm encircle a front cavity, the box body includes a bottom wall and a side wall extending from the bottom wall, the speaker is provided with a sound outlet channel penetrating through the side wall, and the sound outlet channel is communicated with the front cavity. However, when high-frequency components and high-frequency noise are amplified due to resonance of the front cavity, or when high-frequency response or high-frequency noise is relatively high, the hearing is seriously influenced.

Therefore, it is desired to provide a speaker to overcome the aforesaid problems.

BRIEF DESCRIPTION OF THE DRAWINGS

Many aspects of the embodiments can be better understood with reference to the following drawings. The components in the drawing are not necessarily drawn to scale, the emphasis instead being placed upon clearly illustrating the principles of the present disclosure. Moreover, in the drawings, like reference numerals designate corresponding parts throughout the several views.

DETAILED DESCRIPTION

Figure 1:
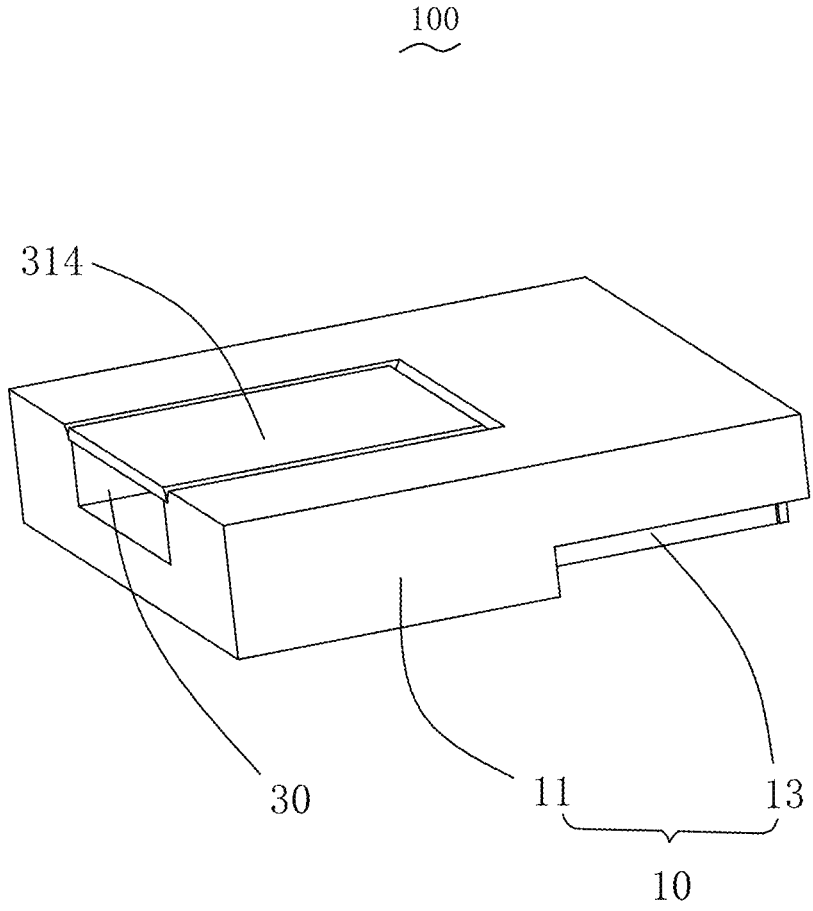
FIG. 1 is a schematic diagram of a three-dimensional structure of embodiment 1 of a speaker of the present disclosure.
Figure 2:
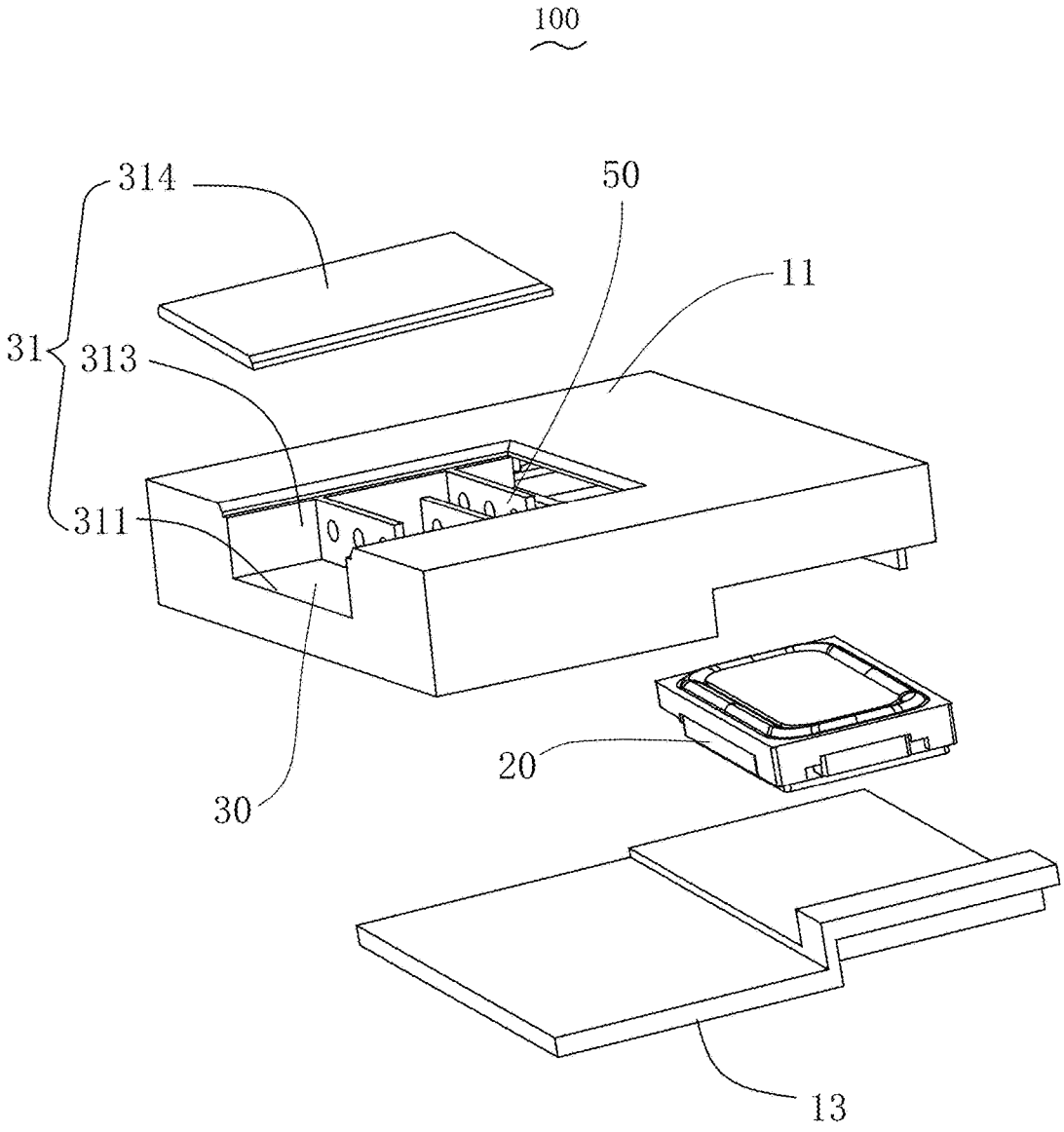
FIG. 2 is a schematic diagram of a three-dimensional exploded structure of the speaker shown in FIG. 1.
Figure 3:
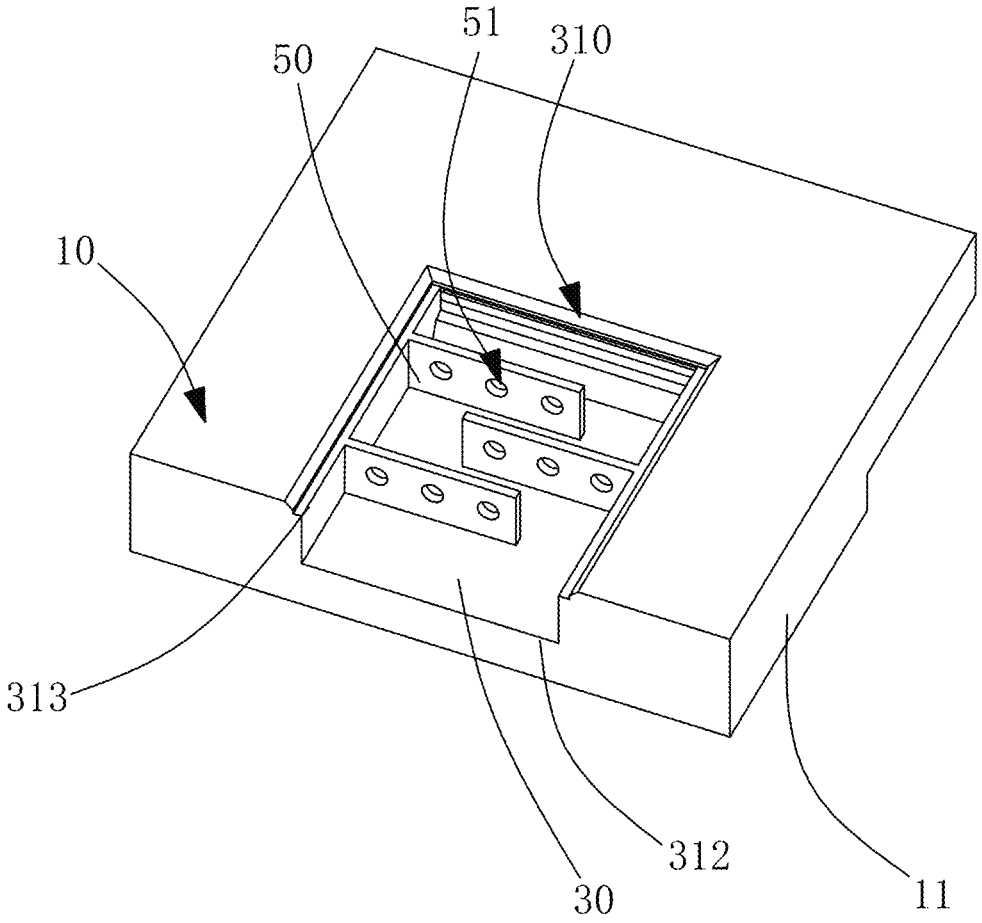
FIG. 3 is a schematic diagram of a three-dimensional structure in which the cover plate is removed from the speaker shown in FIG. 1.
Figure 4:
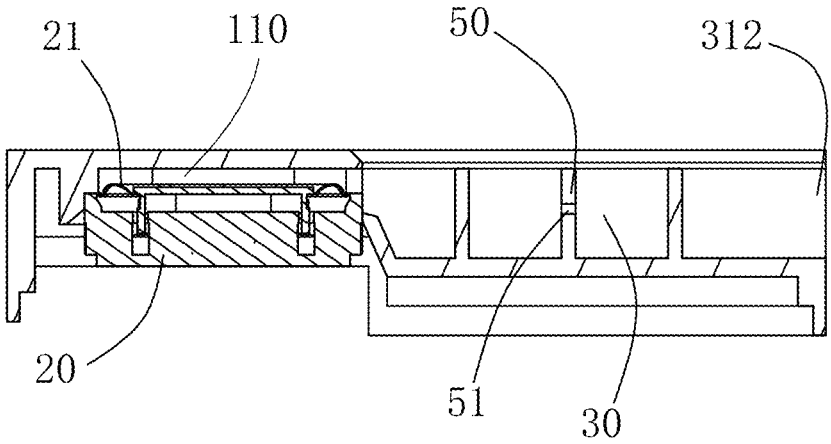
FIG. 4 is a cross-sectional view of the speaker shown in FIG. 1.

The present disclosure will be described in detail below with reference to the attached drawings and embodiments thereof.

Embodiment 1

Referring to FIGS. 1-4, a speaker 100 includes a box body 10 with a receiving space and a sound production unit 20 received in the receiving space. The box body 10 includes an upper shell 11 and a lower shell 13 engaged with the upper shell 11, and the upper shell 11 and the lower shell 13 jointly encircle the receiving space. The sound production unit 20 includes a diaphragm 21 for vibrating to produce sound, and a front sound cavity 110 is formed between the diaphragm 21 and the upper shell 11.

The box body 10 further includes a sound outlet channel 30 communicating the front sound cavity 110 with the outside. The sound outlet channel 30 is formed in the receiving space of the box body 10. The sound outlet channel 30 is encircled by an inner wall 31, two ends of the inner wall 31 are opened, one end forms a communicating port 310 communicated with the front sound cavity 110, the other end penetrates through the box body 10 to form a sound outlet 312 communicating the sound outlet channel 30 with the outside, and the sound outlet 312 is opposite to the communicating port 310. The inner wall 31 includes a sound outlet bottom wall 311, a sound outlet side wall 313 bent and extended along the sound outlet bottom wall 311 in the same direction, and a cover plate 314 covering the side wall 313, wherein the sound outlet bottom wall 311 and the sound outlet side wall 313 form an open end, and the cover plate 314 covers the open end. The cover plate 314, the sound outlet bottom wall 311 and the sound outlet side wall 313 encircle the sound outlet channel 30.

The box body 10 further includes a plurality of baffles 50 disposed in the sound outlet channel 30. The baffles 50 vertically extend from the side wall 313 of the inner wall 31 to the opposite side respectively, the extending direction of the baffles 50 is perpendicular to that of the front sound cavity 110, a clearance is formed between the baffles 50 and the opposite side, and a channel is formed in the clearance. The plurality of baffles 50 are staggered at intervals and parallel to each other, the distances between the adjacent baffles 50 are identical, and each baffle 50 is provided with a plurality of through holes 51. The through holes 51 in the two adjacent baffles 50 are staggered in the extending direction of the sound outlet channel 30, and the through holes 51 in the two spaced baffles 50 are opposite in the extending direction of the sound outlet channel 30. Each baffle 50 is perpendicular to the cover plate 314 and presses against the cover plate 314.

Embodiment 2

Figure 5:
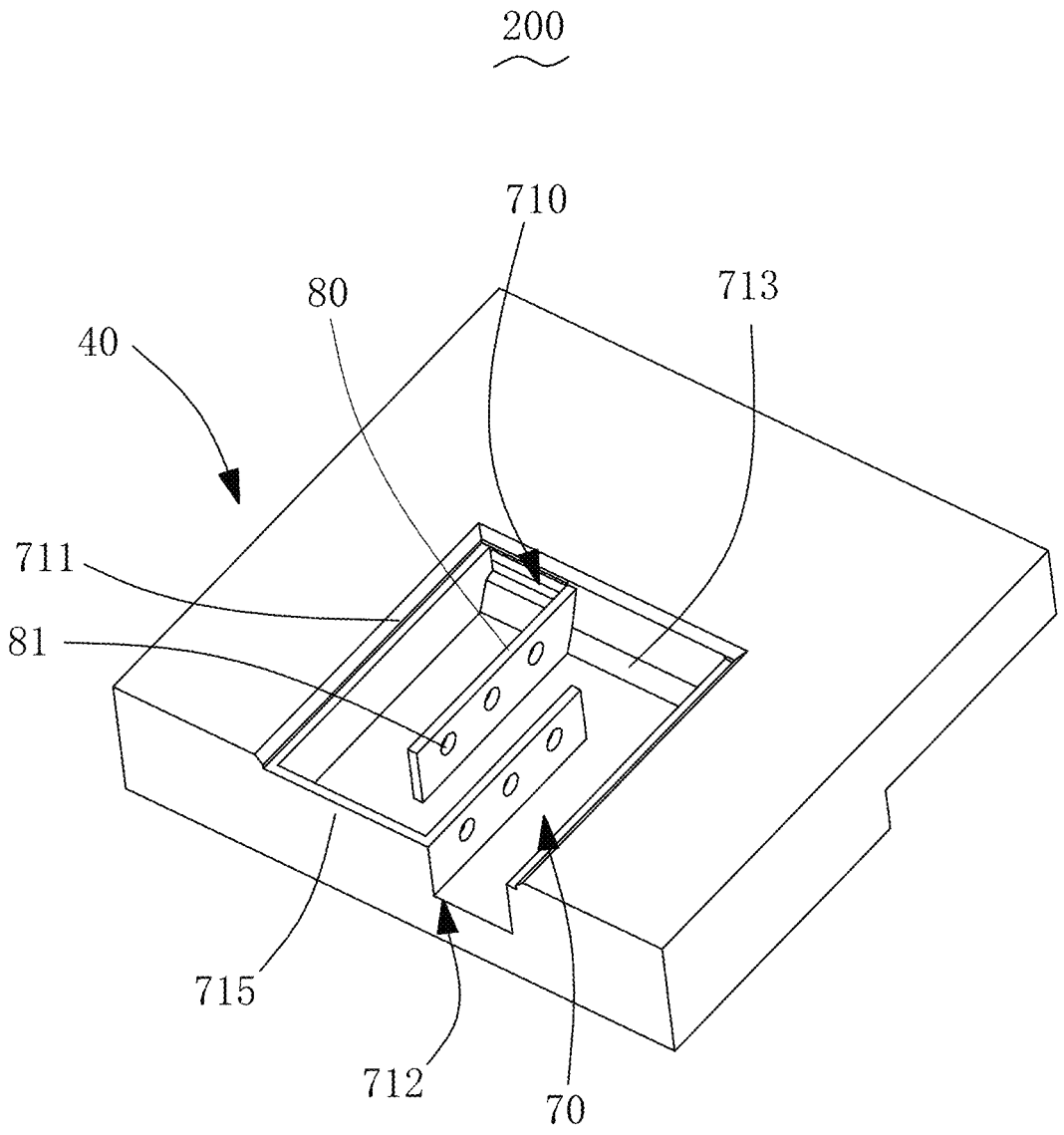
FIG. 5 is a schematic diagram of a three-dimensional structure of a speaker from which a cover plate is removed in embodiment 2 of the present disclosure.

Referring to FIG. 5, a speaker 200 includes a box body 40 and a sound production unit (not shown in the figure), the box body 40 includes a sound outlet channel 70 and a plurality of baffles 80 disposed in the sound outlet channel 70, and each baffle 80 is provided with a plurality of through holes 81. The structure of the speaker 200 is roughly similar to that of the speaker 100 of embodiment 1, and the difference lies in that: the sound outlet 712 is staggered with the communicating port 710, the inner wall 71 further includes a first connecting wall 713 for separating the front sound cavity (not shown in the figure) from the sound outlet channel 70 and a second connecting wall 715 extending along one side of the sound outlet side wall 711 away from the front sound cavity, the second connecting wall 715 is parallel to and partially opposite to the first connecting wall 713, the communicating port 710 is formed in the first connecting wall 713, and the sound outlet 712 is formed in the second connecting wall 715. The baffles 80 vertically extend along the first connecting wall 713 and the second connecting wall 715 respectively, and are located at the opposite part of the first connecting wall 713 and the second connecting wall 715.

It could be understood that the baffles 50 or 80 are not limited in shape, quantity and extending direction, e.g., can be in the shape of circular plates, in a number of three or four or in other quantity, as long as the baffles 50 or 80 are staggered in the sound outlet channel 30 or 70, and each baffle is provided with through holes. The through holes 51 or 81 are also not limited in quantity, shape and interval, e.g., can be square, elliptical, triangular, etc.

Embodiment 3

Figure 6:
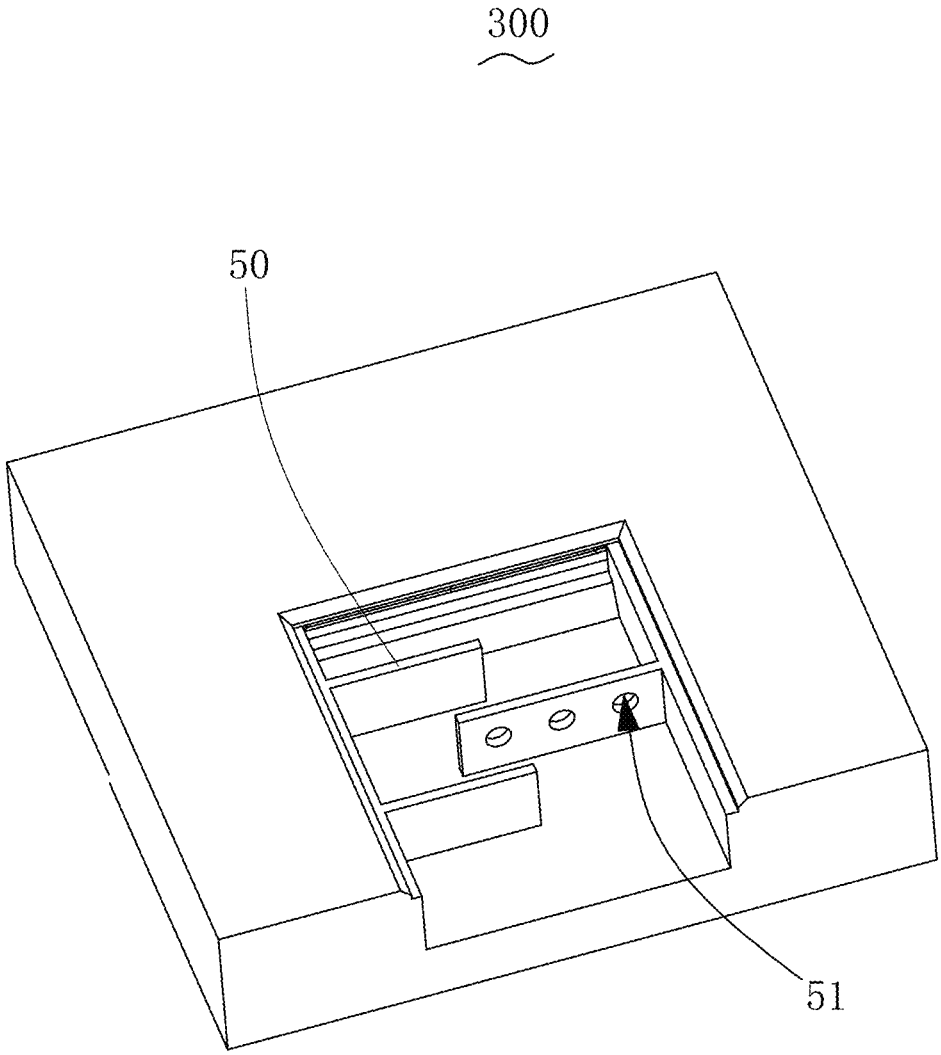
FIG. 6 is a schematic diagram of a three-dimensional structure of a speaker from which a cover plate is removed in embodiment 3 of the present disclosure.

Referring to FIG. 6, the structure of a speaker 300 is roughly similar to that of the speaker 100 of embodiment 1, and the difference lies in that: one of the two adjacent baffles 50 is provided with a plurality of through holes 51, and the distance between the two adjacent through holes 51 is identical.

In combination with embodiment 1, embodiment 2 and embodiment 3, it is supposed that λ is wavelength, f is frequency, c is sound velocity 340 m/s, n is a natural number, y1 is a distance from the edge of the channel to the through holes 51 or 81 and $\lambda f=c$, when $2*y1=\lambda/2*(2n+1)$, the phase difference of sound wave passing through the channel and the through holes 51 or 81 and having the wavelength λ is 180°, so that a selective silencing effect on multiple bands is achieved.

Embodiment 4

Figure 7:
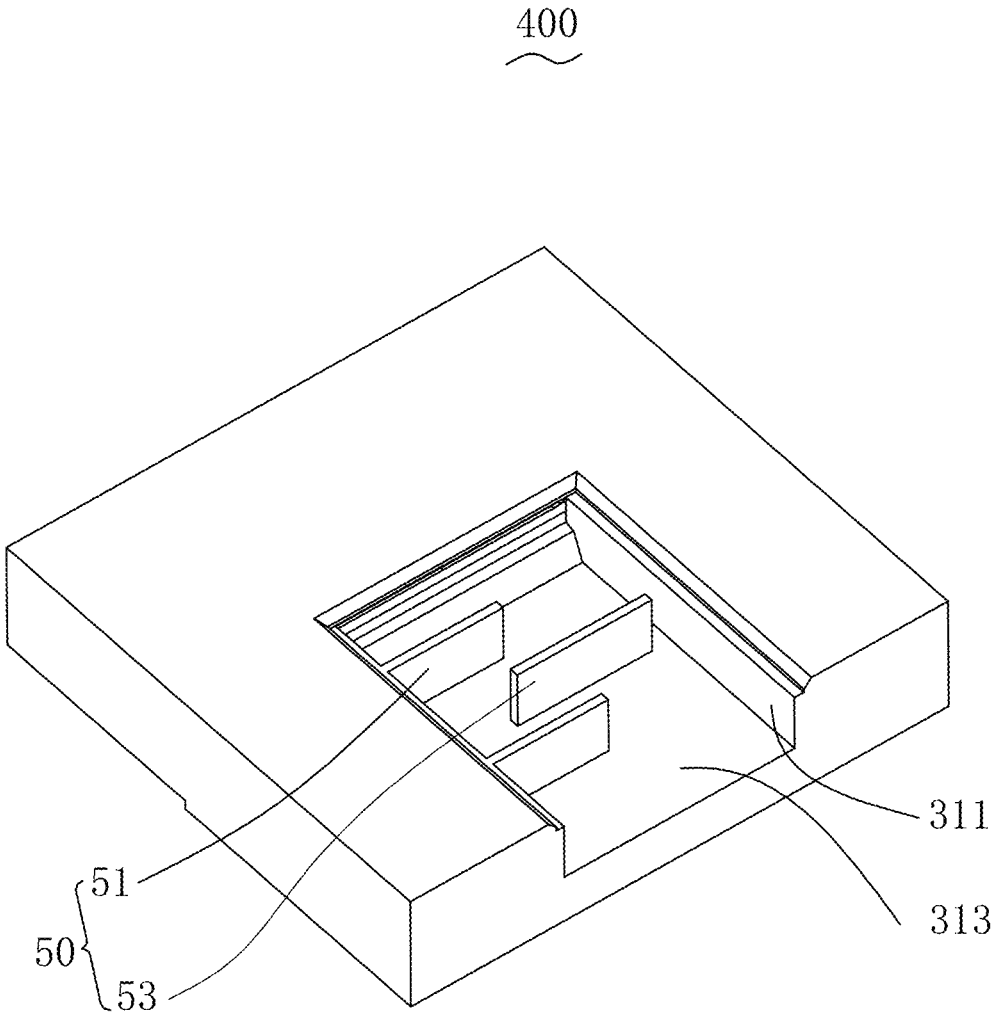
FIG. 7 is a schematic diagram of a three-dimensional structure of a speaker from which a cover plate is removed in embodiment 4 of the present disclosure.

Referring to FIG. 7, the structure of a speaker 400 is roughly similar to that of the speaker 100 of embodiment 1, and the difference lies in that: the baffles 50 are not provided with through holes, and two opposite ends of at least one baffle are respectively spaced from the inner wall 31. Specifically, the baffles 50 include two first baffles 51 extending in parallel from the same-side sound outlet side wall 311 to the opposite side and a second baffle 53 extending from the sound outlet bottom wall 313 to the cover plate (not shown in the figure), a clearance is preset between the first baffles 51 and the opposite-side sound outlet side wall 311, and the distances between the first baffles 51 and the opposite-side sound outlet side wall 311 are equal; the second baffle 53 is sandwiched between the two adjacent first baffles 51, two ends of the second baffle 53 are respectively spaced from the sound outlet side wall 311, and the distances between the two ends of the second baffle 53 and the sound outlet side wall 311 are unequal. The first baffles 51 are parallel to the second baffle 53.

Embodiment 5

Figure 8:
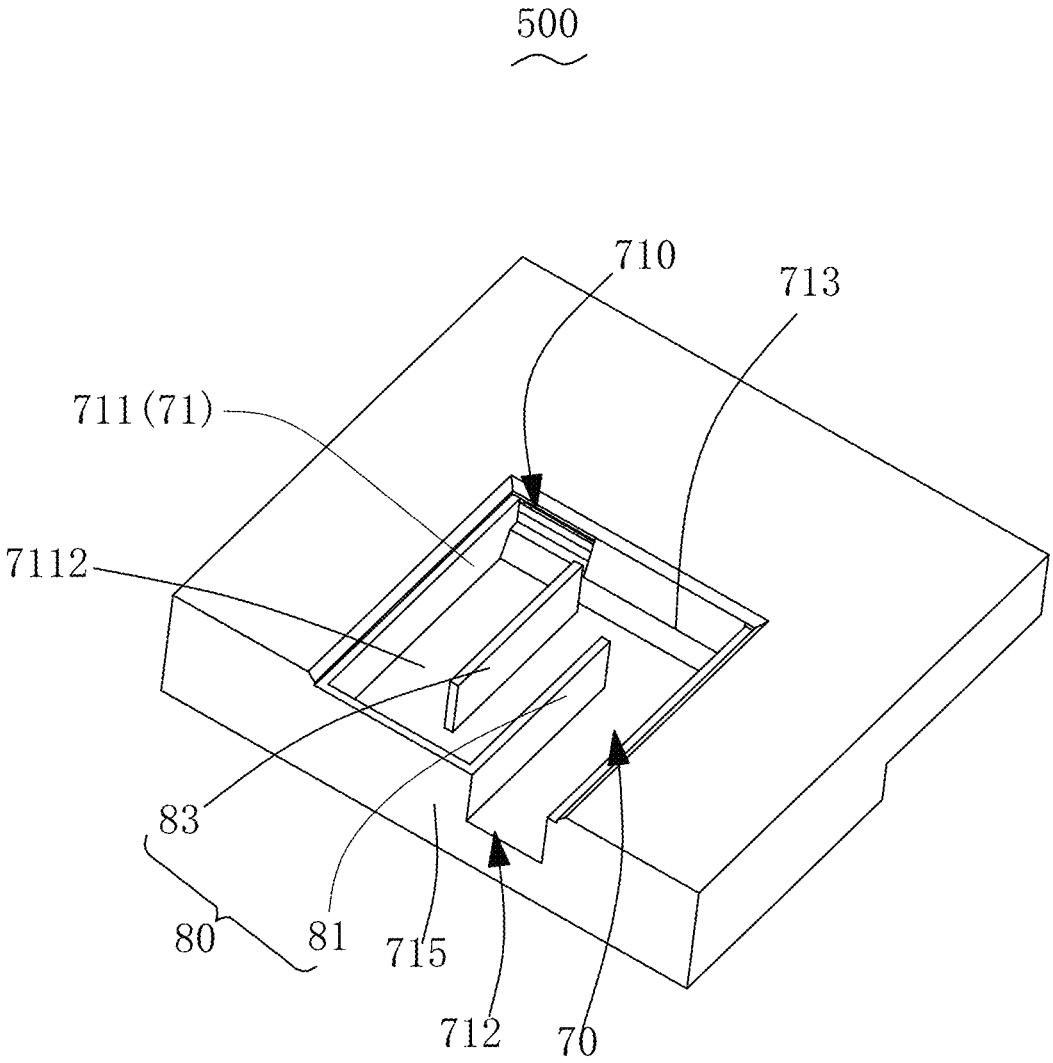
FIG. 8 is a schematic diagram of a three-dimensional structure of a speaker from which a cover plate is removed in embodiment 5 of the present disclosure.

Referring to FIG. 8, the structure of a speaker 500 is roughly similar to that of the speaker 400 of embodiment 4, and the difference lies in that: the sound outlet 712 is staggered with the communicating port 710, the inner wall 71 further includes a first connecting wall 713 for separating the front sound cavity from the sound outlet channel 70 and a second connecting wall 715 extending along one side of the sound outlet side wall 711 away from the front sound cavity, the second connecting wall 715 is parallel to and partially opposite to the first connecting wall 713, the communicating port 710 is formed in the first connecting wall 713, and the sound outlet 712 is formed in the second connecting wall 715. The baffles 80 include a third baffle 81 extending towards the opposite side along the first connecting wall 713 and/or the second connecting wall 715 and a fourth baffle 83 extending from the sound outlet bottom wall 7112 to the cover plate (not shown in the figure), two ends of the fourth baffle 83 are respectively spaced from the first connecting wall 713 and the second connecting wall 715, and the distances between the two ends of the fourth baffle 83 and the first connecting wall 713 and the second connecting wall 715 are unequal.

In combination with embodiment 4 and embodiment 5, it is supposed that λ is wavelength, f is frequency, c is sound velocity 340 m/s, n is a natural number, y1 is a distance from the edge of the sound outlet channel to the two ends of the baffles and $\lambda f=c$, when $2*y1=\lambda/2*(2n+1)$, the phase difference of sound wave passing through the two ends of the second baffle 53 or the two ends of the fourth baffle 83 and having the wavelength λ is 180°, so that a selective silencing effect on multiple bands is achieved.

By adopting the structure of the speaker of the present disclosure over the speaker with one end opened, the range of selectively absorbed bands can be increased, and the sound absorbing effect on each band can be increased. A plurality of baffles can repeatedly absorb sound over the structure provided with only one baffle, so that the sound absorbing effect can be increased. Meanwhile, this structure can partially increase the length of the sound outlet channel, partially increase the acoustic resistance and also increase the absorbing effect on high-frequency components and noise. Generally, because the size for measuring the sound production box is limited and the low-frequency sound wave is very long, the silencing effect does not greatly influence main working bands of low frequency and the like. Therefore, this structure can selectively reduce high-frequency harmonic peaks and other high-frequency components and achieve the effect of improving hearing.

Compared with the prior art, the speaker provided by the present disclosure has the advantages that a plurality of baffles staggered at intervals are disposed in the sound outlet channel, and the phase difference of sound wave passing through different channels respectively and having the wavelength λ is 180°, so that a selective silencing effect on multiple bands is achieved; meanwhile, this structure can partially increase the length of the sound outlet channel, partially increase the acoustic resistance and also increase the absorbing effect on high-frequency components and noise.

It is to be understood, however, that even though numerous characteristics and advantages of the present embodiments have been set forth in the foregoing description, together with details of the structures and functions of the embodiments, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A speaker, comprising:

a box body with a receiving space; and a sound production unit received in the receiving space;

wherein the sound production unit comprises a diaphragm for vibrating to produce sound, the diaphragm is spaced from the box body to form a front sound cavity, and the box body comprises a sound outlet channel communicating the front sound cavity with the outside and a plurality of baffles disposed in the sound outlet channel and staggered at intervals;

and an inner wall encircling the sound outlet channel is formed in the box body, two ends of the inner wall are opened, one end forms a communicating port communicated with the front sound cavity, the other end penetrates through the box body to form a sound outlet communicating the sound outlet channel with the outside, and the baffles respectively extend from the inner wall to the opposite side at staggered intervals.

2. The speaker as described in claim 1, wherein at least one of the two adjacent baffles is provided with through holes.

3. The speaker as described in claim 2, wherein an inner wall encircling the sound outlet channel is formed in the box body, two ends of the inner wall are opened, one end forms a communicating port communicated with the front sound cavity, the other end penetrates through the box body to form a sound outlet communicating the sound outlet channel with the outside, and the baffles respectively extend from the inner wall to the opposite side at staggered intervals.

4. The speaker as described in claim 3, wherein the inner wall comprises a sound outlet bottom wall parallel to the diaphragm, a sound outlet side wall bent from two ends of the sound outlet bottom wall in the same direction and a cover plate covering the sound outlet side wall, the sound outlet bottom wall and the sound outlet side wall form an open end, the cover plate covers the open end and encircles the sound outlet channel together with the sound outlet side wall and the sound outlet bottom wall, and the baffles are perpendicular to the cover plate and press against the cover plate.

5. The speaker as described in claim 4, wherein the sound outlet is opposite to the communicating port, and the baffles extend vertically from the sound outlet side wall and/or the sound outlet bottom wall and are parallel to the vibrating direction of the diaphragm.

6. The speaker as described in claim 4, wherein the sound outlet is staggered with the communicating port, the inner wall further comprises a first connecting wall for separating the front sound cavity from the sound outlet channel and a second connecting wall extending along one side of the sound outlet side wall away from the front sound cavity, the second connecting wall is parallel to and partially opposite to the first connecting wall, the communicating port is formed in the first connecting wall, and the sound outlet is formed in the second connecting wall.

7. The speaker as described in claim 6, wherein the baffles vertically extend along the first connecting wall and the second connecting wall respectively, and are located at the opposite part of the first connecting wall and the second connecting wall.

8. The speaker as described in claim 2, wherein each baffle is provided with through holes.

9. The speaker as described in claim 8, wherein the through holes in the two adjacent baffles are staggered in the extending direction of the sound outlet channel, and the through holes in the two spaced baffles are opposite in the extending direction of the sound outlet channel.

10. The speaker as described in claim 1, wherein the plurality of baffles are staggered at equal intervals and in parallel.

11. The speaker as described in claim 1, wherein two opposite ends of at least one baffle are respectively spaced from the inner wall.

12. The speaker as described in claim 11, wherein the inner wall comprises a sound outlet bottom wall parallel to the diaphragm, a sound outlet side wall bent from two ends of the sound outlet bottom wall in the same direction and a cover plate covering the sound outlet side wall, the sound outlet bottom wall and the sound outlet side wall form an open end, the cover plate covers the open end and encircles the sound outlet channel together with the sound outlet side wall and the sound outlet bottom wall, and the baffles are perpendicular to the cover plate and press against the cover plate.

13. The speaker as described in claim 12, wherein the baffles comprise first baffles extending in parallel from the same-side sound outlet side wall to the opposite side and a second baffle extending from the bottom wall to the cover plate, the second baffle is sandwiched between the two adjacent first baffles, and two ends of the second baffle are respectively spaced from the sound outlet side wall.

14. The speaker as described in claim 12, wherein the sound outlet is staggered with the communicating port, the inner wall further comprises a first connecting wall for separating the front sound cavity from the sound outlet channel and a second connecting wall extending along one side of the sound outlet side wall away from the front sound cavity, the second connecting wall is parallel to and partially opposite to the first connecting wall, the communicating port is formed in the first connecting wall, and the sound outlet is formed in the second connecting wall.

15. The speaker as described in claim 14, wherein the baffles comprise a third baffle extending towards the opposite side along the first connecting wall and/or the second connecting wall and a fourth baffle extending from the sound outlet bottom wall to the cover plate, and two ends of the fourth baffle are respectively spaced from the first connecting wall and the second connecting wall.

16. The speaker as described in claim 15, wherein the baffles are located at the opposite part of the first connecting wall and the second connecting wall.

17. The speaker as described in claim 16, wherein the distances between the two ends of the fourth baffle and the first connecting wall and the second connecting wall are unequal.

* * * * *